US010077968B2

(12) United States Patent
Liang

(10) Patent No.: US 10,077,968 B2
(45) Date of Patent: Sep. 18, 2018

(54) FAST GUN HOLSTER

(71) Applicant: APS Ltd, Hong Kong (HK)

(72) Inventor: Guodong Liang, Hong Kong (HK)

( * ) Notice: Subject to any disclaimer, the term of this patent is extended or adjusted under 35 U.S.C. 154(b) by 0 days.

(21) Appl. No.: 15/334,739

(22) Filed: Oct. 26, 2016

(65) Prior Publication Data

US 2017/0122702 A1 May 4, 2017

(30) Foreign Application Priority Data

Oct. 29, 2015 (CN) ..... 2015 1 0729626

(51) Int. Cl.
*F41C 33/02* (2006.01)

(52) U.S. Cl.
CPC ..... *F41C 33/0272* (2013.01)

(58) Field of Classification Search
CPC ..... F41C 33/0272; F41C 33/0263; F41C 33/0245; F41C 33/0236; Y10S 224/911; Y10S 224/912
USPC ..... 224/244
See application file for complete search history.

(56) References Cited

U.S. PATENT DOCUMENTS

| | | | | |
|---|---|---|---|---|
| 3,008,617 | A * | 11/1961 | Villwock | F41C 33/0209 224/183 |
| 4,934,574 | A * | 6/1990 | Salandre | F41C 33/0209 224/244 |
| 8,302,827 | B1 * | 11/2012 | Cole | F41C 9/02 224/243 |
| 8,544,706 | B2 * | 10/2013 | Crye | F41C 33/045 224/193 |
| 9,297,612 | B2 * | 3/2016 | Schmadeka | F41C 33/048 |
| 9,816,778 | B2 * | 11/2017 | Bardy | F41C 33/02 |
| 2016/0109203 | A1 * | 4/2016 | Madia, II | F41A 17/54 42/70.07 |

* cited by examiner

*Primary Examiner* — Adam Waggenspack
(74) *Attorney, Agent, or Firm* — Wayne & King LLC

(57) ABSTRACT

A fast gun holster is disclosed. The fast gun holster comprises a holster body and a connecting base. The holster body comprises a barrel receiver used for containing a gun barrel. An installing plate is hinged to one side of the gun barrel receiver through a reset spring and provided with a trigger limiting mechanism. The trigger limiting mechanism comprises a protrusion and a pressing piece. A clamping groove matched with a trigger is formed in the protrusion. The bottom end of the pressing piece is hinged to the installing plate through a reset spring. An arc part matched with the inner side of a trigger guard is formed on the periphery of the pressing piece.

5 Claims, 8 Drawing Sheets

FAST GUN HOLSTER

TECHNICAL FIELD

This invention relates to a gun holster, in particle to a fast gun holster.

BACKGROUND

Gun holster is a necessary equipment of law enforcement officer and a police with a gun, which can carry and protect the gun and prevent the gun being robbed. According to the regulations of the state, when executing a task, a law enforcement officer or a police with a gun should guarantee the gun to be placed safely. Existing gun holster, always has a function preventing the dropping out. When the gun is put inside the gun holster, the gun holster can not limit the trigger, which will cause an accidentally shoot because of vibration or misoperation, and which is also a hidden danger for the people carrying the gun and others around. Therefore, existing gun holster needs to be improved.

SUMMARY

In order to overcome the defect of the existing technology, the present invention provides a fast gun holster having a trigger limiting function. The use safety is improved, fast trigger limiting, fast trigger limiting releasing and quick gun using can be achieved in the using process.

The technical solution adapted in the present invention to solve the technical problem is as below:

A fast gun holster, comprises a holster body and a connecting base, wherein the holster body comprises a barrel receiver used for receiving a barrel therein, and wherein a first side of the barrel receiver is provided with a barrel opening which enables the barrel to move out of the barrel receiver. An attaching side of the barrel receiver is hinged with an installing plate; wherein the installing plate is provided with a trigger limiting mechanism; wherein the trigger limiting mechanism comprises a protrusion and a pressing piece; wherein the protrusion comprises a clamping groove matched with a trigger; wherein a bottom end of the pressing piece is hinged to the installing plate; wherein the periphery of the pressing piece comprises an arc part adapted to an internal wall of a trigger guard; wherein an upper end of the arc part comprises an inclined surface for giving place to the trigger guard; wherein the-pressing piece further comprises a clamping mouth under the arc part, for clamping the trigger guard.

As the improvement of the above technical solution, the installing plate further comprises a pivoting block for clamping the barrel receiver and the installing plate; wherein the pivoting block is disposed on an installing groove provided in the installing plate, one end of the pivoting block is attached to the installing groove; when the pressing piece is toggled inwardly, the pressing piece contacts the pivoting block and makes the pivoting block rotate, thereby releasing the barrel receiver from the installing plate.

Furthermore, the pivoting block is rotatably mounted on an installing frame; wherein the pivoting block is provided with an inclined adapting surface; wherein the-pressing piece is provided with a pushing clamping mouth matched with the adapting surface.

Furthermore, the pivoting block is provided with a protrusion part at the front end of the pivoting block, an end of the protrusion part is provided with an inclined surface inclining outward, the barrel receiver is provided with a groove matched with the protrusion part.

Furthermore, a periphery of the protrusion is matched with the internal wall of the trigger guard.

Furthermore, a pressing part of the pressing piece is provided with an anti-slip stripe.

The beneficial effects of the invention are: a fast gun holster, comprises a holster body and a connecting base. The holster body comprises a barrel receiver used for receiving a barrel therein. One side of the barrel receiver is hinged with an installing plate through a reset spring. The barrel receiver can be rotated and ejected relative to the installing plate under the action of the reset spring. When in use, inserting the gun barrel into the barrel receiver, and then pressing the barrel receiver towards the installing plate, which drives the trigger guard to be pressed to the pressing piece of the trigger limiting mechanism. As the pressing piece is provided with an arc part matched with the inner side of a trigger guard and the arc part is formed with an inclined face giving place to the trigger guard, the trigger guard can push the pressing piece and drive the pressing piece to moved inward. When the trigger guard is pressed in place, the pressing piece backs to original position under the action of the reset spring and therefore makes the clamping opening clamp the trigger guard, so as to fix and limit the barrel receiver. At the same time, the trigger in the trigger guard clamps into the clamping groove formed on the protrusion of the trigger limiting mechanism. The trigger is limited in the clamping groove. When release the limit of the trigger is desired, only need to press the pressing piece inward, then barrel receiver will be rotated and ejected to original position under the action of the reset spring, so as to release the limit of the trigger quickly. By means of the trigger limiting mechanism, hidden danger caused by vibration or mistaken touch is avoided when a gun is placed in the gun holster, and the use safety is improved. Meanwhile, the gun holster can be operated with one hand, fast trigger limiting, fast trigger limiting releasing and quick gun using can be achieved in the using process.

BRIEF DESCRIPTION OF THE DRAWINGS

The present invention will be further described accompanying with Figures and embodiments.

DETAILED DESCRIPTION OF THE EMBODIMENTS

Figure 1:
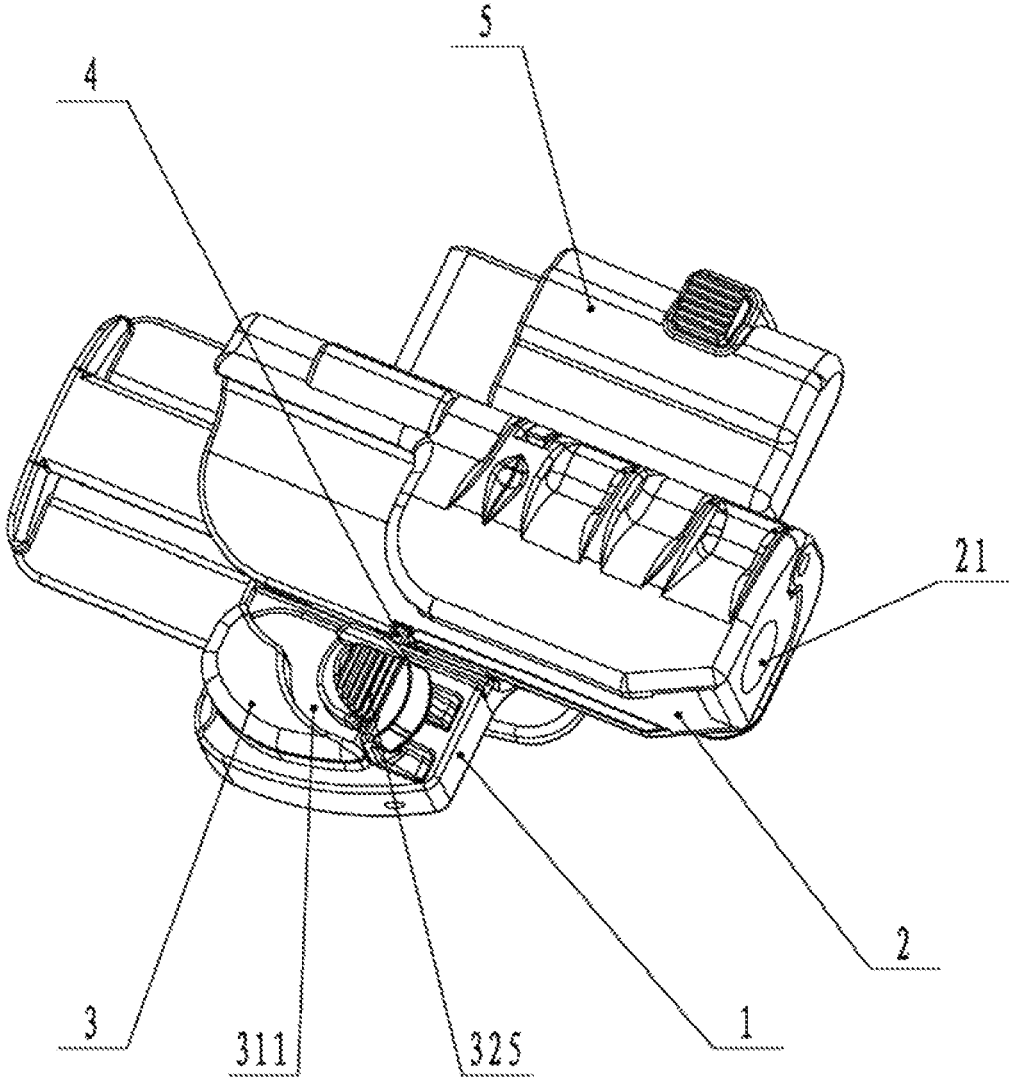
FIG. 1 is a structural diagram of the invention.
Figure 2:
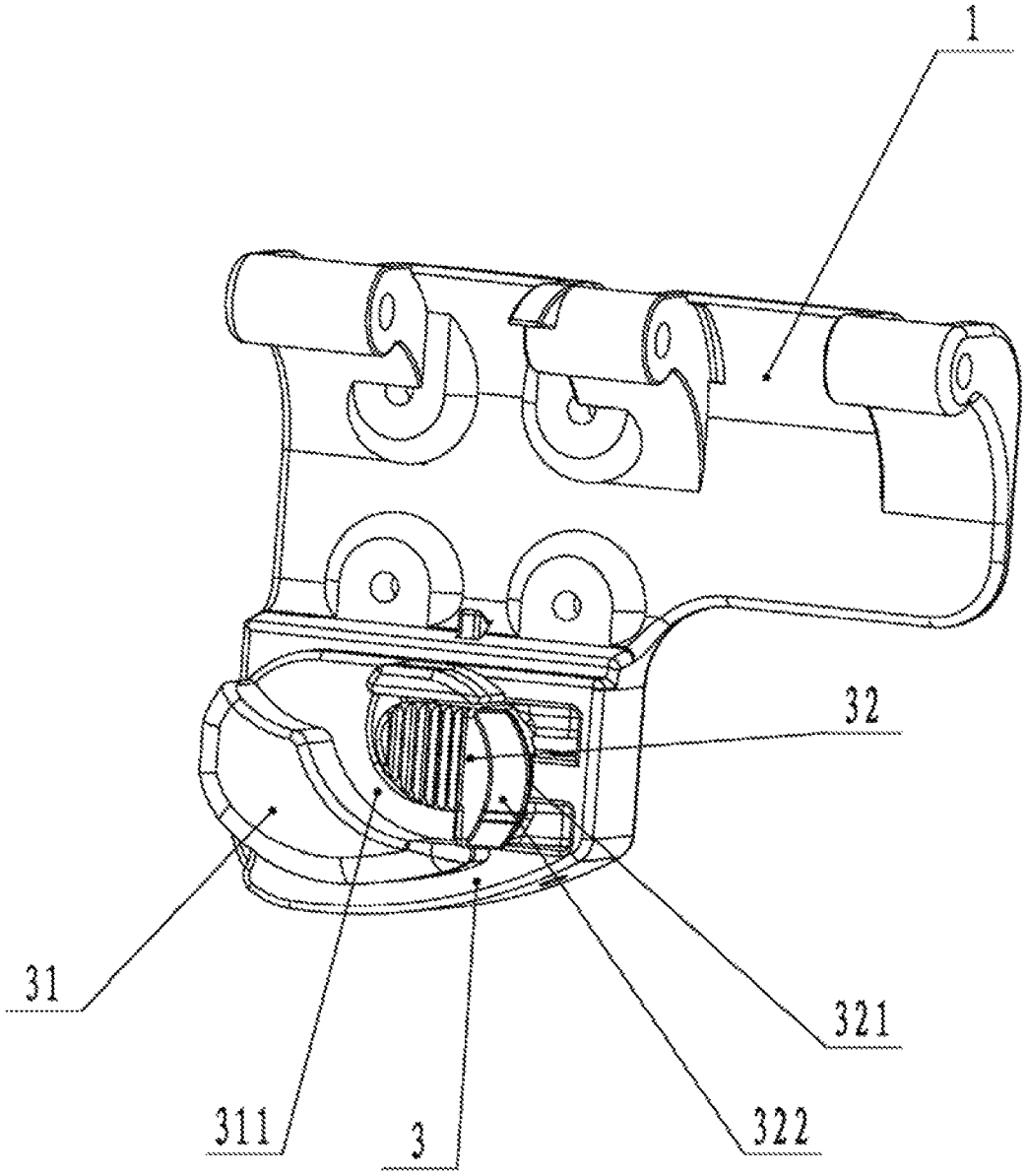
FIG. 2 is a structural diagram of an installing plate.
Figure 3:
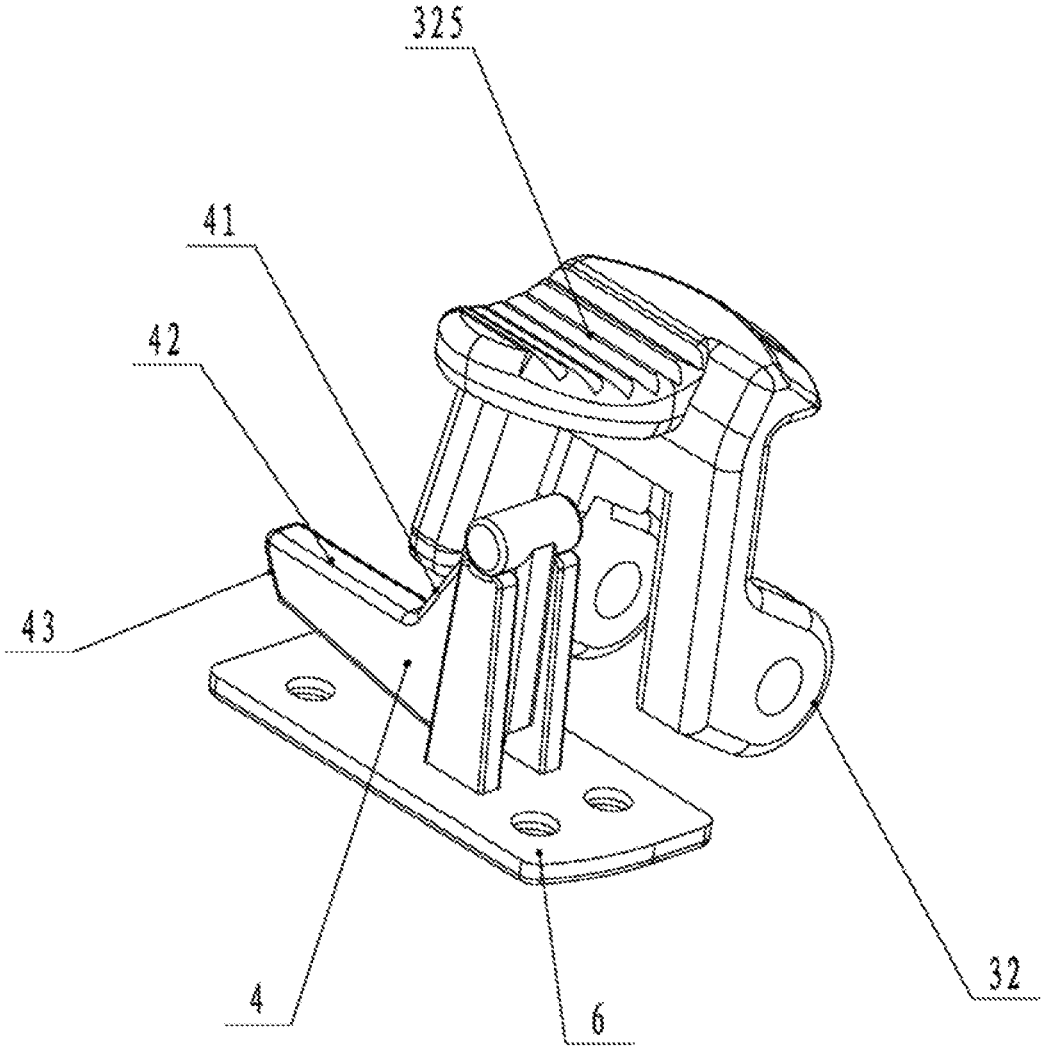
FIG. 3 is an assembly diagram of a pressing piece and a pivoting block.
Figure 4:
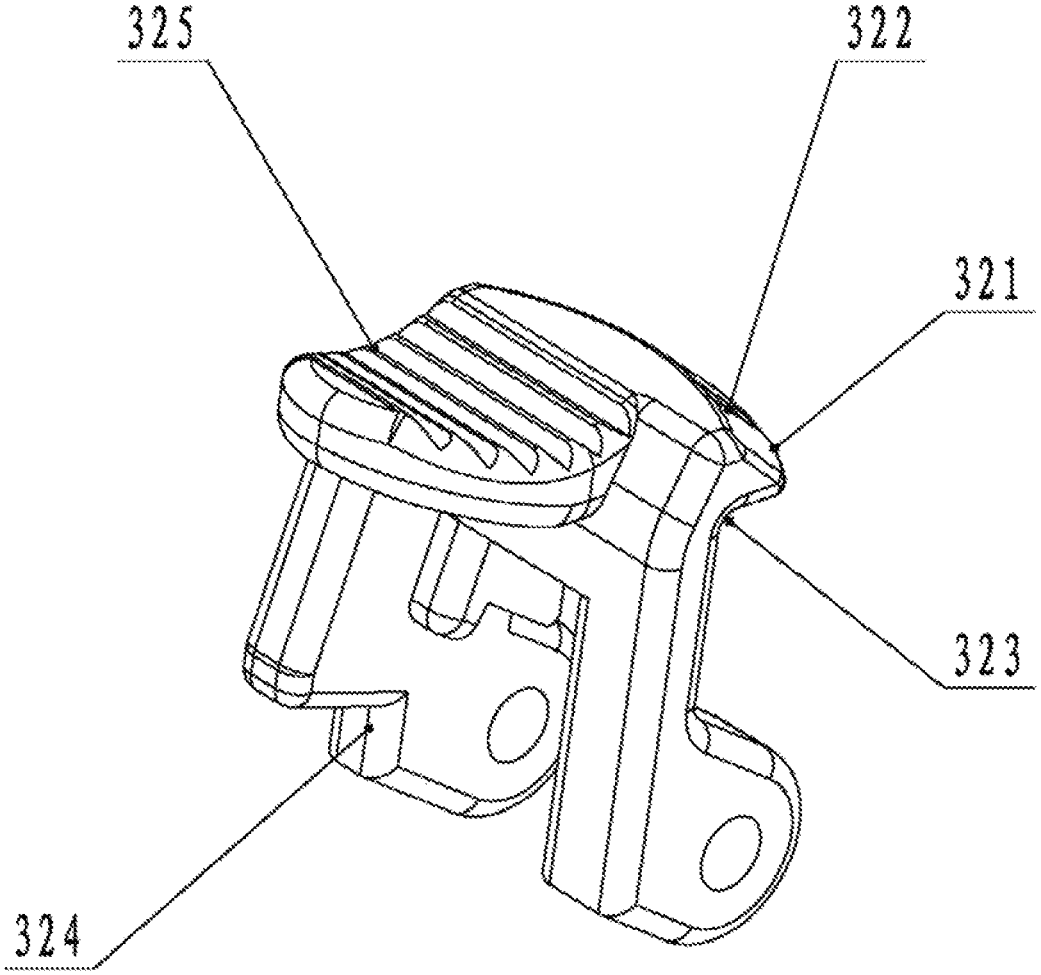
FIG. 4 is a structural diagram of the pressing piece.
Figure 5:
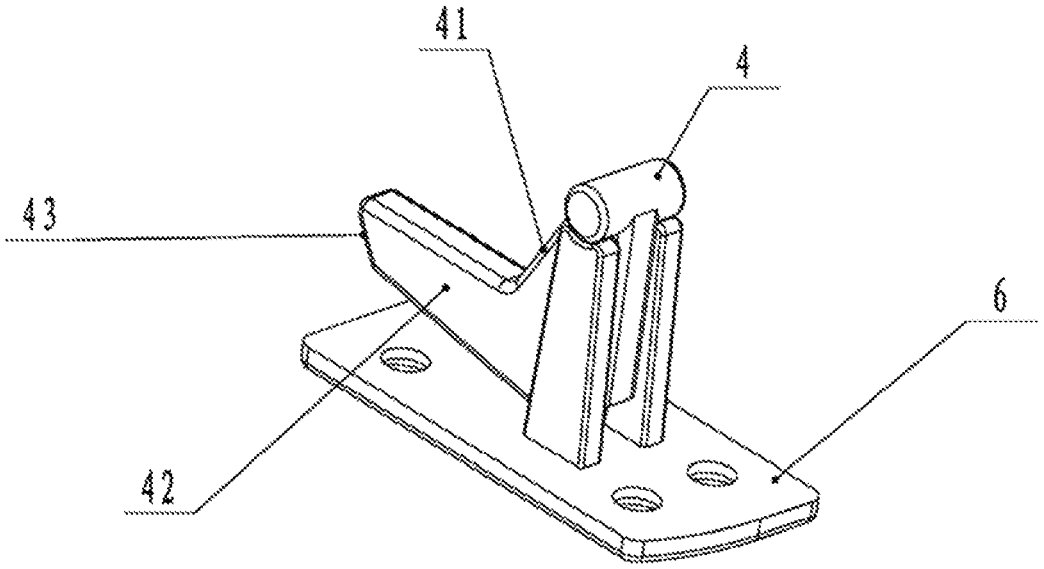
FIG. 5 is schematic diagram of the pivoting block attached to an installing frame.
Figure 6:
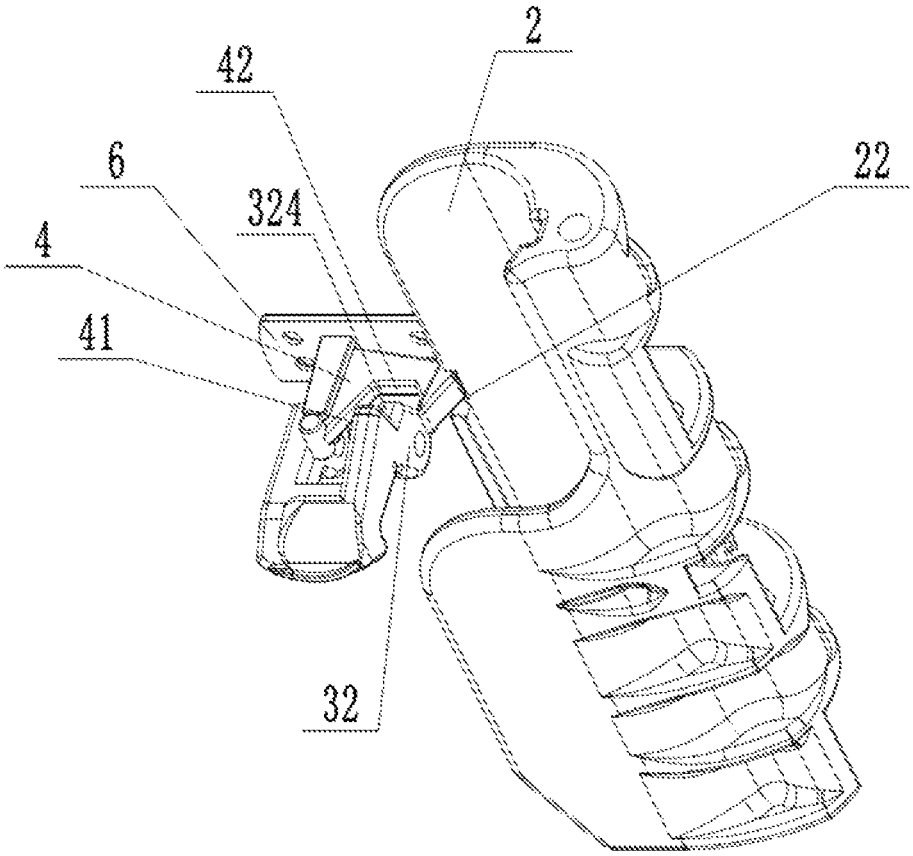
FIG. 6 is an assembly diagram of the pressing piece, the pivoting block and the barrel receiver, wherein the installing plate is not shown.
Figure 7:
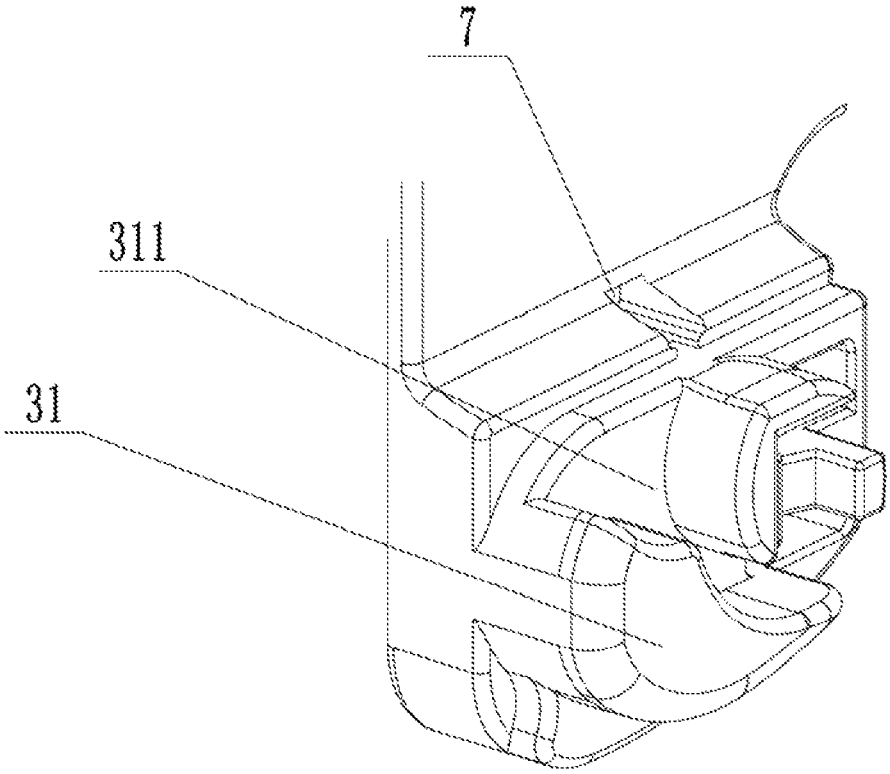
FIG. 7 is a schematic view of a trigger limiting part of the installing plate showing the installing plate without the pressing piece and the pivoting block from one angle.
Figure 8:
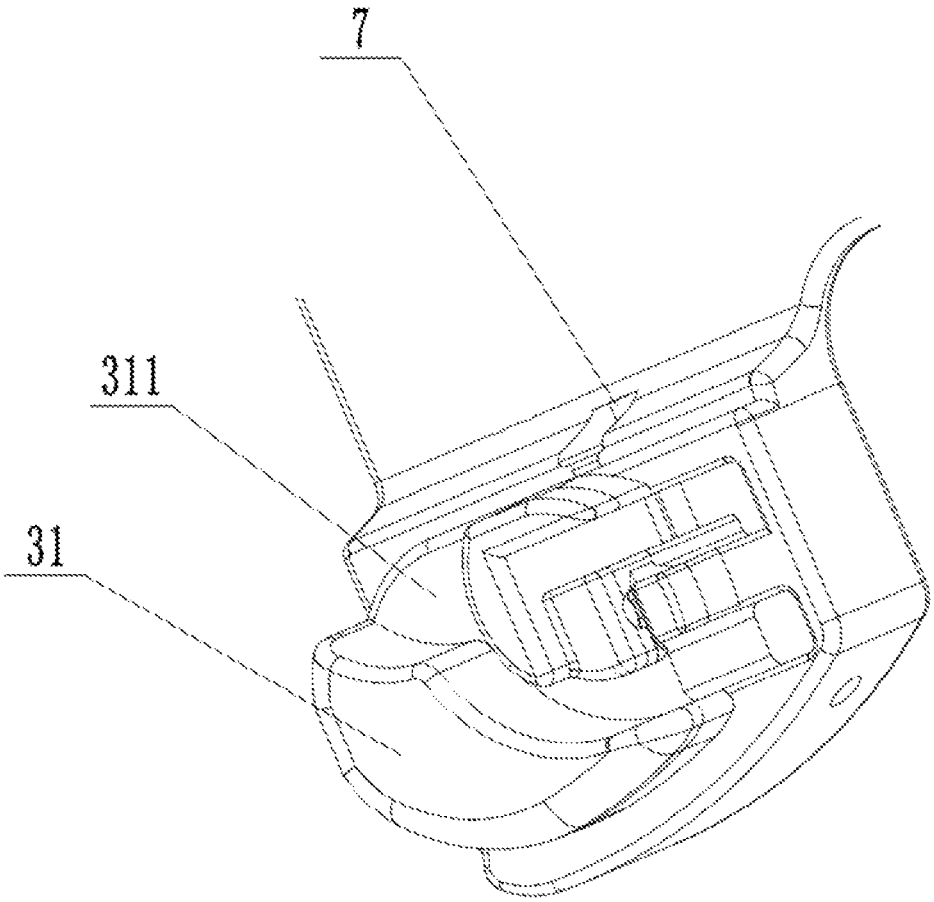
FIG. 8 is a schematic view of the trigger limiting part of the installing plate showing the installing plate without the pressing piece and the pivoting block from another angle.

Referring to FIGS. 1-8, a fast gun holster, comprises a holster body and a connecting base 5 used to connect the gun holster to a belt or the like, which makes it convenient to wear. The holster body comprises a barrel receiver 2 used for receiving a barrel therein. A front end of the barrel receiver 2 is provided with a barrel opening 21 used for the gun barrel to move outward, such that a user can load the gun quickly, which improves the practicability of the gun holster. One side of the barrel receiver 2 is hinged with an installing plate 1 by a reset spring. The barrel receiver 2 can be rotated and ejected relative to the installing plate 1 under the action of the reset spring. The installing plate 1 is provided with a trigger limiting mechanism 3. The trigger limiting mechanism 3 comprises a protrusion 31 and a-pressing piece 32. The protrusion 31 is formed with a clamping groove 311 matched with a trigger. A bottom end of the pressing piece 32 is hinged to the installing plate 1 through a reset spring. Preferably, the reset spring is a torsional spring. The periphery of the pressing piece 32 is formed with an arc part 321. An upper end of the arc part 321 is formed with an inclined face 322 giving place to a trigger guard. The part, located at the lower end of the arc part 321, of the pressing piece 32 is provided with a clamping mouth 323 used for clamping the trigger guard. When in use, inserting the gun barrel into the barrel receiver 2, and then pressing the barrel receiver 2 towards the installing plate 1, which drives the trigger guard being pressed to the pressing piece 32 of the trigger limiting mechanism 3. As the pressing piece 32 is provided with an arc part 321 matched with the inner side of a trigger guard and the arc part 321 is formed with an inclined face giving place to the trigger guard, the trigger guard can push the pressing piece 32 and drive the pressing piece 32 to move inward, when the trigger guard is pressed in place, the pressing piece 32 stirs back under the action of the reset spring to make the clamping mouth 323 clamp the trigger guard, so as to fix and limit the barrel receiver 2. At the same time, the trigger in the trigger guard clamps into the clamping groove 311 formed on the protrusion 31 of the trigger limiting mechanism 3, the trigger is limited in the clamping groove 311, and quickly limiting the trigger is achieved. When want to release the limit of the trigger, only need to stir the pressing piece 32 inward, then barrel receiver 2 is rotated and ejected to home position under the action of the reset spring, so as to release the limit of the trigger quickly. Preferably, the angle between the barrel receiver 2 and the installing plate 1 is 60° when the barrel receiver 2 is ejected to the home position, the operation of the gun holster is convenient under this angle. Certainly, other angles can also be used, the present invention is not limited to this. By means of the trigger limiting mechanism, accidental discharge caused by vibration or mistaken touch is avoided when a gun is placed in the gun holster, and the use safety is improved. Meanwhile, the gun holster can be operated with one hand, fast trigger limiting and fast trigger limiting releasing can be achieved in the using process, and using is fast and convenient.

In order to further improve the stability of the barrel receiver 2 when being pressed to be limited at the installing plate 1, and prevent the trigger guard from being separated from the clamping mouth 323 of the pressing piece 32 and releasing the limit, the installing plate 1 further comprises a pivoting block 4 used to clamp the barrel receiver 2. The pivoting block 4 is disposed on an installing groove 7 provided in the installing plate 1. One end of the pivoting block 4 is connected with a spring member which is used to push the pivoting block 4 out of the installing groove 7. When the pressing piece 32 is toggled inward, the pivoting block 4 is driven to rotate and release the barrel receiver 2. Specifically, the pivoting block 4 is rotatably mounted on an installing frame 6, the pivoting block 4 is provided with an inclined adapting face 41. The pressing piece 32 is provided with a pushing clamping mouth 324 matched with the adapting face 41. When the pressing piece 32 is toggled inward, the pushing clamping mouth 324 pushes the adapting face 41 of the pivoting block 4 downward and makes the pivoting block 4 rotate away from the barrel receiver 2, so as to release the limit of the barrel receiver 2. In order to improve the clamping ability of pivoting block 4 with respect to the barrel receiver 2, the pivoting block 4 is provided with a protrusion part 42 at the front end of the pivoting block 4. An end of the protrusion part 42 is provided with an inclined surface 43 inclining outward. The barrel receiver 2 is provided with a groove 22 matched with the protrusion part 42. By providing the inclined surface 43 on the pivoting block 4 and the groove 22 on the barrel receiver 2 respectively, a larger contact area between the pivoting block 4 and the barrel receiver 2 and a better clamping effect are achieved. At the same time, under the action of the reset spring, the pivoting block 4 tends to turn over outward. When turning over outward, the barrel receiver 2 drives the pivoting block 4 to rotate to further push the groove 22, so as to prevent the barrel receiver 2 from being ejected because of vibration.

In the present embodiment, the periphery of the protrusion 31 is matched with the inner side of the trigger guard. The outer edge of the protrusion 31 is provided with an arc structure which is convenient for the trigger guard to slide in smoothly and improves the convenience of the operation.

Preferably, the pressing part of the pressing piece 32 is provided with anti-slip stripe 325. By setting the anti-slip stripe 325, the accuracy and convenience of the operation is improved, the situation that failing to press the pressing piece due to the hand sweat is avoided, and the using convenience is improved.

The description stated above are preferable embodiments of the present invention. The present invention is not limited to the above embodiments. Any same or similar means achieving the technical effects of the invention should fall the scope of the present invention.

I claim:

1. A fast gun holster, comprising a holster body and a connecting base; wherein the holster body comprises a barrel receiver for receiving a gun barrel therein and an installing plate attached to the barrel receiver;

the barrel receiver comprises an opening at an end in a direction of the gun barrel, allowing the gun barrel to extend out from inside of the barrel receiver;

wherein the installing plate comprises an attaching part and a trigger limiting part;

wherein the barrel receiver comprises a plurality of first hinge heads arranged at an interval, and the installing plate comprises a plurality of second hinge heads on the attaching part arranged at the interval; when the barrel receiver and the installing plate are assembled, the plurality of first hinge heads and the plurality of second hinge heads are alternately hinged with each other;

wherein the trigger limiting part comprises a protrusion, a pressing piece, and a clamping groove partially surrounded by the protrusion; wherein a periphery of the trigger limiting part is shaped to conform with a trigger guard, and the clamping groove is shaped for receiving a trigger;

wherein the pressing piece is disposed within a first installing groove on the installing plate, with a first end of the pressing piece being inserted into the first installing grove and a second end of the pressing piece being partially extended from the first installing groove;

wherein the second end of the pressing piece, which is partially extended from the first installing groove, comprises an arc part adapted to an internal wall of the trigger guard, allowing the trigger guard to slide along; wherein the pressing piece further comprises a clamping mouth under the arc part for clamping the trigger guard.

2. The fast gun holster of claim 1, further comprising a rotating block, wherein the installing plate further comprises a second installing groove; the pivoting block comprises a third end of the pivoting block rotatably attached to the installing plate within the second installing groove, and a fourth end partially extended from an opening of the second installing groove for abutting against the barrel receiver; wherein the fourth end of the pivoting block comprises an inclined adapting surface;

wherein the first installing groove is in communication with the second installing groove of the installing plate, enabling the pressing piece to contact the pivoting block when the pressing piece is toggled by external force and causes the pivoting block to rotate; wherein a rotation of the pivoting block driven by the pressing piece makes the fourth end of the pivoting block stop being abutted against the barrel receiver.

3. The fast gun holster of claim 2, wherein the pressing piece further comprises a pushing clamping mouth shaped to conform with the inclined adapting surface; when the pressing piece is toggled, the pushing clamping mouth is pushed to contact the inclined adapting surface and resulting in the rotation of the pivoting block, and thereby releasing an abutment between the pivoting block and the barrel receiver.

4. The fast gun holster of claim 2, wherein the barrel receiver further comprises a groove at an edge which is adjacent to the installing plate; wherein the groove is shaped to conform with a protrusion part of the pivoting block.

5. The fast gun holster of claim 1, wherein a pressing part of the pressing piece is provided with an anti-slip stripe.

* * * * *